US005393024A

United States Patent [19]

Daubenspeck

[11] Patent Number: 5,393,024

[45] **Date of Patent: * Feb. 28, 1995**

[54] WATER HEATER TANK SUPPORT

[76] Inventor: Richard P. Daubenspeck, 23275 Caminito Marcial, Laguna Hills, Calif. 92653

[ * ] Notice: The portion of the term of this patent subsequent to Mar. 2, 2010 has been disclaimed.

[21] Appl. No.: 937,150

[22] Filed: Aug. 31, 1992

Related U.S. Application Data

[63] Continuation-in-part of Ser. No. 758,335, Aug. 28, 1991, Pat. No. 5,190,260, which is a continuation of Ser. No. 581,039, Sep. 12, 1990, abandoned.

[51] Int. Cl.[6] ..... A47K 17/00

[52] U.S. Cl. ..... 248/313; 248/74.3; 248/146

[58] Field of Search ..... 248/146, 154, 313, 74.3, 248/74.4, 231, 316.6; 126/363; 220/476, 481, 562, 565

[56] References Cited

U.S. PATENT DOCUMENTS

| | | | |
|---|---|---|---|
| 1,427,375 | 8/1922 | Gove | 248/313 |
| 1,649,265 | 11/1927 | Tetens | 248/313 X |
| 2,463,880 | 3/1949 | Jones | 220/565 X |
| 2,870,982 | 1/1959 | Greene et al. | 248/146 |
| 4,020,531 | 5/1977 | Ahrens et al. | 248/73 X |
| 4,783,030 | 11/1988 | Buerhop | 248/74.4 |
| 4,955,573 | 9/1990 | Horvath | 248/313 |
| 5,020,760 | 6/1991 | Mayr | 248/313 |
| 5,190,260 | 3/1993 | Daubenspeck | 248/313 |

FOREIGN PATENT DOCUMENTS

| | | | |
|---|---|---|---|
| 1007098 | 4/1952 | France | 248/74.4 |
| 601713 | 7/1978 | Switzerland | 248/74.4 |

*Primary Examiner*—Eugenia Jones

[57] ABSTRACT

A water heater tank support system for securing a water heater tank to an adjacent wall is disclosed. The system comprises first and second mounting brackets connected to the wall and disposed on opposite sides of the tank. Each of the mounting brackets includes a mounting surface disposed proximate a peripheral portion of the tank. A first strap is provided that goes in back of the water tank and over the mounting surfaces of the brackets. A second strap is provided that goes in front of the tank and over the mounting surfaces of the brackets. Shims are provided between the straps and with the formers, the straps with the shims are attached to the brackets.

13 Claims, 2 Drawing Sheets

WATER HEATER TANK SUPPORT

This application is a continuation-in part of serial no. 07/758,335, filed Aug. 28, 1991, and now U.S. Pat. No. 5,190,260, which is a continuation of Ser. No. 07/581,039, filed Sep. 12, 1990, and now abandoned.

BACKGROUND OF THE INVENTION

The present invention relates to adjustable support systems and, more particularly to apparatus for supporting a water heater tank against and to an adjacent wall.

Water heaters of various sizes are commonly found in residential and commercial buildings throughout the country. Because such devices are typically mass produced for distribution throughout the country they are not typically constructed to include bracing devices to prevent movement of the water heater tank in the event of an earthquake or other violent motions. Such movement of the water heater tank in response to seismic activity can result in the tank breaking way from its installed position, causing damage to the tank as well as potential fire or water damage.

Although prior water heater tank bracing devices have been proposed such devices are either formed as an integral portion of the manufactured device, designed for installation prior to installation of the water heater tank, or require removal of the water tank in order to install and/or mount the bracing device. Such contemporary devices are therefore inadequate to satisfy the practical needs of most users who are unable or unwilling to remove the water heater tank from its existing location in order to install the support device and do not buy water heater tanks with such pre-mounted devices. Thus, there exists a need for a device that can serve to secure the water heater tank to an existing wall without the need to remove the water heater from its existing location. There exists a further need for such a bracing device which can accommodate different size water heaters and be easily installed by individuals having little or no mechanical or construction experience. The present invention is directed to a water heater tank support system that satisfies these and other needs not met by existing apparatus, as described in more detail below.

SUMMARY OF THE INVENTION

A water heater tank support system for securing a water heater tank to an adjacent wall is disclosed. The system comprises first and second mounting brackets connected to the wall and disposed on opposite sides of the tank. Each of the mounting brackets includes a first portion disposed proximate a peripheral portion of the tank. A strap is provided which extends behind the water tank and over the flat end of the brackets. A similar strap is provided that extends in front of the tank and over the flat ends of the brackets. Shims are provided to fill any gaps left between the fiat ends of the two straps. Formers are provided above the flat ends of the outer strap. In turn, the formers, the straps and the shims are attached to the brackets.

The invention further comprises means for adjustably securing the straps to the first and second brackets to regulate tension of the straps to the tank. Also spacing members may be provided intermediate the brackets and the wall to adjustably position the brackets with respect to the tank. Mounting members may be provided intermediate the bracket and the wall to facilitate mounting the brackets to the wall.

BRIEF DESCRIPTION OF THE DRAWINGS

FIGS. 4*a* and 4*b* are views of an alternative mounting bracket for use in conjunction with the present invention; a plastic molding with threaded inserts.

DETAILED DESCRIPTION OF THE PRESENTLY PREFERRED EMBODIMENT

The detailed description set forth below in connection with the appended drawings is intended merely as a description of the presently preferred embodiment of the invention, and is not intended to represent the only form in which the present invention may be constructed or utilized. The description sets forth the functions and steps for installing the invention, in connection with the illustrated embodiment. It is to be understood, however, that the same, or equivalent functions or installation steps may be accomplished by different embodiments that are also intended to be encompassed within the spirit and scope of the invention.

Figure 1:
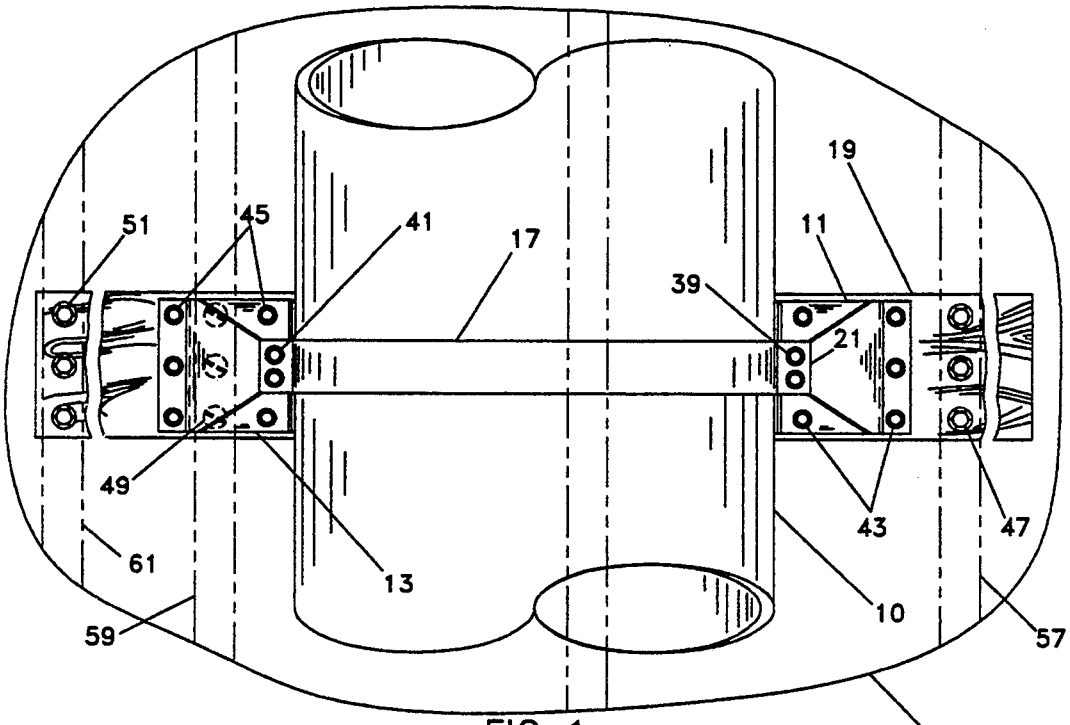
FIG. 1 is a front view of the presently preferred embodiment of the invention as extending about a water heater tank.
Figure 2:
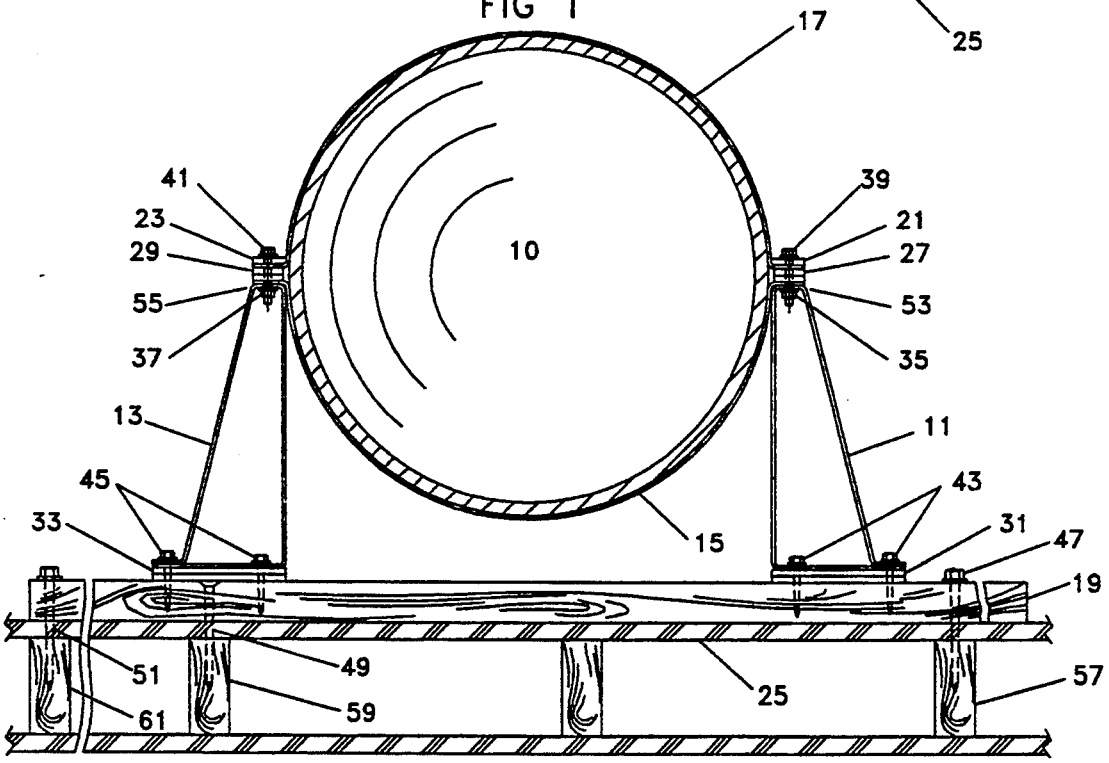
FIG. 2 is a top view of the embodiment set forth at FIG. 1.

Referring to the drawings and, more particularly to FIGS. 1 and 2, illustrating the present invention as used to maintain water heater tank 10 in place against wall 25. Brackets 11 and 13 are shown mounted against beam 19 which, in turn, is mounted to wall 25. In the illustrated embodiment wall 25 is typically formed of material such as plasterboard as is typically found in many residential and commercial environments. However, it is to be understood that the present invention may be utilized to secure a water heater in place against an available wall of any type of construction, e.g. wood, metal, etc.

In the illustrated embodiment the brackets 11 and 13 are secured to beam 19 by means of any convenient fastener such as screws, or other fasteners. Beam 19, which may be made of Grade 1 Douglas Fir or other material, is preferably secured to plasterboard wall 25 by means of fasteners 47, 49 and 51 extending into wall studs 57, 59 and 61. Fasteners 47, 49 and 51 may similarly be any available type of fastener such as screws, nails or the like, which can secure the brackets in place and accommodate the tension utilized to hold the water heater tank 10 in place.

Beam 19 and brackets 11 and 13 may be installed without need to remove water heater 10. As shown at FIGS. 1 and 2, the brackets 11 and 13 are secured to beam 19 outside the diameter of the tank. Thus, the installation of the invention may be accomplished by individuals having little or no mechanical or construction skills.

Brackets 11 and 13 are preferably formed to have flat portions or mounting surface 53 and 55 extending slightly below the periphery of tank 10 at its widest point. It is to be understood, however, that various alternative constructions of the brackets 11 and 13 may be utilized such that the location of the brackets with respect to the periphery of tank 10 may be varied in accordance with the particular construction used. To facilitate the location of portions 53 and 55 with respect to tank 10 spacers 31 and 33 may be used to move portions 53 and 55 to the desired location.

The inner strap 15 and the outer strap 17 may be identical. Their lengths are determined by one half the diameter of tank 10 less allowance for variance in the tank's diameter and straps tolerances. Straps 15 and 17 may be preformed and drilled for attachment to brackets 11 and 13.

Strap 15 is placed behind the tank and over the brackets 11 and 13. Strap 17 is placed over the tank and over the brackets 11 and 13. Shims 27 and 29 are placed between the gaps left by straps 15 and 17. Formers 21 and 23 are placed above the flattened ends of straps 17 and thereon bolted to brackets 11 and 13 to self-locking nut plates 35 and 37.

In the presently preferred embodiment that the bracket may be of steel or aluminum extrusion. However, it is anticipated that the brackets may be of aluminum or steel sheet, casting, machined part or molded plastic instead, and that nut plates 35 and 37 are installed on the brackets to provide for the attachment of the straps and formers 21 and 23.

In the presently preferred embodiment the straps 15 and 17 are of preformed aluminum and drilled sheet. However, other materials as corded cloth fabric with wires running lengthwise entwined in the cloth, aluminum sheet metal, steel sheet metal, leather, plastic or nylon with impregnated wires extending lengthwise therethrough may alternatively be used. In the presently preferred embodiment the former 21 and 23 are made of aluminum plate.

Figure 3A:
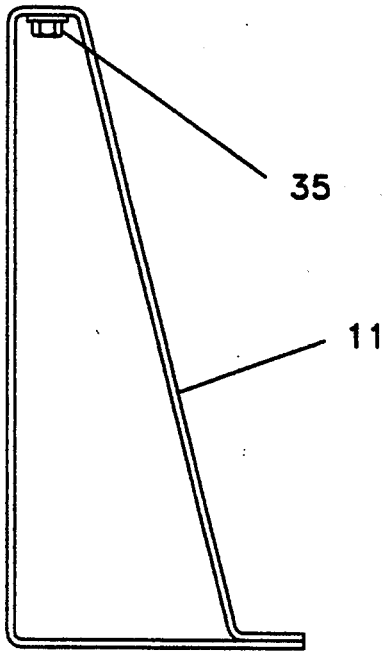
FIGS. 3*a* and 3*b* are views of an exemplary mounting bracket used in conjunction with the present invention.
Figure 3B:
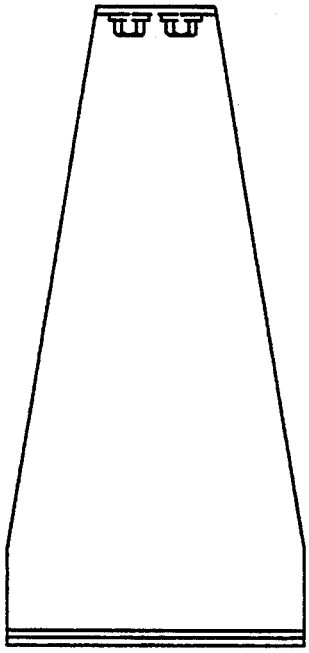
Figure 4A:
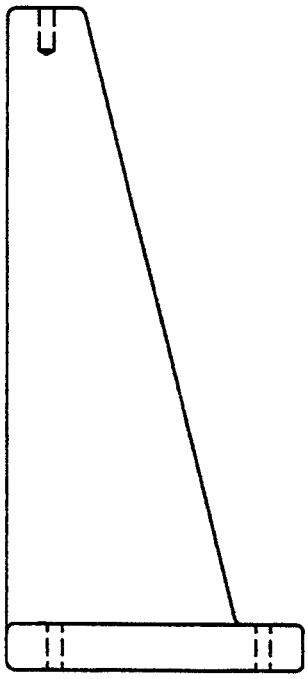
Figure 4A:
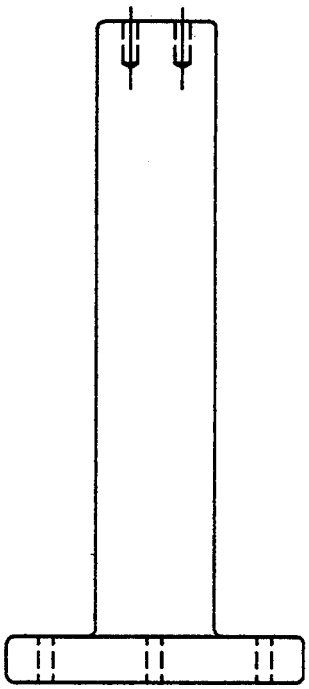

FIGS. 3*a* and 3*b* illustrate an enlarged view of bracket 11. FIGS. 4*a* and 4*b* illustrate alternative constructions of the bracket, a plastic molding with a threaded insert that may be used in conjunction with the present invention. It is to be understood that various designs of the brackets may be implemented consistent with the type of materials used to form the bracket.

A typical installation procedure for utilizing the present invention is as follows. Where the invention is to be used to support the water heater tank against a plasterboard wall; a beam is typically used to support the brackets against the wall. However, a beam may not be required where the wall 19 is constructed of wood, brick or metal, i.e. the brackets may be installed directly to the wall if feasible. Spacers may be used as necessary to extend the brackets from the wall to the desired point adjacent the tank.

Inner strap 15 may be disposed intermediate the brackets and the tank and laid over brackets 11 and 13 to determine the proper spacing of the brackets along the beam. Fasteners 39 and 41 may temporarily be placed in the holes in the inner strap 15 and the brackets 11 and 13. This would determine the number of spacers 31 and 33 to be added between the brackets 11 and 13 and the beam 19 to give the proper fitting to tank 10. Place strap 17 over the outer tank and the brackets 11 and 13. Add shims 27 and 29 required to give proper tension to tank 10. Then add formers 21 and 23 above strap 17, fasten former 21, strap 17, shim 27, and strap 15 to bracket 11 with fastener 39, and fasten former 23, strap 17, shim 29, and strap 15 to bracket 13 with fastener 41.

As described above, the foregoing description represents only the presently preferred embodiment of the invention. Various modifications, additions and substitutions may be made to the invention without departing from the spirit or scope of the invention.

What is claimed is:

1. A water heater tank and lateral support system comprising:

an elongated vertically oriented, water heater tank;

first and second mounting brackets connected to an adjacent vertical wall and disposed on opposite sides of the tank, each of said brackets having a mounting surface disposed proximate a peripheral portion of the tank and spaced from each other a distance about equal to the diameter of the tank, thereby enabling said brackets to be mounted after the tank is in position adjacent to the wall;

and two straps for securing the water heater tank to said mounting brackets, one of said straps extending over the mounting surface of said first bracket and a portion of the water heater tank facing said wall, and also extending over the mounting surface of said second bracket, and the other of said straps extending over the mounting surface of said first bracket and a portion of the water tank facing away from said wall and also extending over the mounting surface of said second bracket, and both of said straps being secured to both of said brackets.

2. The system of claim 1; wherein said brackets are connected to said wall at locations spaced at least a dimension equal to the outside diameter of said tank.

3. The system as recited in claim 1 further comprising means for adjustably securing the one of said straps facing the wall to the other of said straps facing away from said wall to regulate tension of said straps about the tank.

4. The system recited in claim 1 further comprising means for adjustably securing said straps to said brackets to regulate tension of said straps about the tank.

5. The system as recited in claim 1 further comprising spacing members disposed intermediate said brackets and the wall position said brackets with respect to the tank.

6. The system as recited in claim 1 wherein said first and second mounting brackets are formed of metal.

7. The system as recited in claim 1 wherein said first and second mounting brackets are formed of molded plastic material.

8. The system as recited in claim 1 wherein said straps are sheet metal.

9. The system as recited in claim 1 wherein said straps are of corded cloth with wires running lengthwise therethrough.

10. The system as recited in claim 1 wherein said straps are plastic with impregnated wire running lengthwise therethrough.

11. The system as recited in claim 1 wherein said straps are of leather.

12. The system as recited in claim 1 wherein said straps are of nylon with impregnated wire running lengthwise therethrough.

13. A water heater tank support system for securing a water heater tank to an adjacent wall comprising:

first and second mounting brackets connected to the wall and disposed on opposite sides of the tank at locations spaced at least a dimension equal to the diameter of said tank, each of said brackets having a mounting surface disposed proximate a peripheral portion of the tank and spaced from each other a distance about equal to the diameter of the tank, thereby enabling said brackets to be mounted after the tank is in position adjacent to the wall;

each bracket having a generally triangular configuration with one side of each bracket being attached to said wall, and each of said mounting surfaces of said brackets being an apex of said triangular configuration opposite from said one side, and two straps for securing the water tank to said mounting brackets; one of said straps extending over the mounting surface of said first bracket and a portion of the water heater tank facing said wall, and also extending over the mounting surface of said second bracket, and the other of said straps extending over the mounting surface of said first bracket and a portion of the water tank facing away from said wall and also extending over the mounting surface of said second bracket, and both said straps being secured to both said brackets.

* * * * *